US009498792B2

(12) United States Patent
Miller et al.

(10) Patent No.: US 9,498,792 B2
(45) Date of Patent: Nov. 22, 2016

(54) ROOF ADHESIVE DISTRIBUTION APPARATUS

(71) Applicant: ADCO PRODUCTS, LLC, Michigan Center, MI (US)

(72) Inventors: John W. Miller, Hudson, MI (US); James Galvin, Cleveland, OH (US); Nicholas J. Berard, Novi, MI (US); Robert Reel, Ann Arbor, MI (US); Kathleen Lamb, Jackson, MI (US); Kevin Wiese, North Royalton, OH (US); Steven A. Zetts, Perrysburg, OH (US); Paul Snowwhite, Dexter, MI (US); Scott Ulibarri, Jackson, MI (US); Andy Rouru, Kent, MI (US)

(73) Assignee: ADCO Products, LLC, Michigan Center, MI (US)

( * ) Notice: Subject to any disclaimer, the term of this patent is extended or adjusted under 35 U.S.C. 154(b) by 0 days.

(21) Appl. No.: 14/422,193

(22) PCT Filed: Aug. 23, 2013

(86) PCT No.: PCT/US2013/056429

§ 371 (c)(1),
(2) Date: Feb. 18, 2015

(87) PCT Pub. No.: WO2014/031980

PCT Pub. Date: Feb. 27, 2014

(65) Prior Publication Data

US 2015/0283575 A1 Oct. 8, 2015

Related U.S. Application Data

(60) Provisional application No. 61/692,813, filed on Aug. 24, 2012, provisional application No. 61/713,292, filed on Oct. 12, 2012, provisional application No. 61/737,361, filed on Dec. 14, 2012, provisional application No. 61/806,023, filed on Mar. 28, 2013.

(51) Int. Cl.
*B05B 1/20* (2006.01)
*B05C 17/005* (2006.01)
(Continued)

(52) U.S. Cl.
CPC ..... *B05C 17/00516* (2013.01); *B05B 1/20* (2013.01); *B05B 3/02* (2013.01);
(Continued)

(58) Field of Classification Search
CPC . B05C 17/0516; B05C 5/027; B05C 17/002; B05C 17/005; B05C 17/00583; B05C 17/00589; B05C 17/00553; E04F 21/023; A47G 27/0487; B05B 9/007; B05B 7/2472; B05B 7/0466; B05B 7/0475; B05B 7/04; B05B 3/02; B05B 1/20
USPC ..... 239/76, 553, 553.5, 590, 590.5, 146, 239/150, 303–305, 432, 433, 434, 566, 568, 239/601, 722, 754; 401/48, 282, 285
See application file for complete search history.

(56) References Cited

U.S. PATENT DOCUMENTS 4,893,751 A * 1/1990 Armstrong ..... E01C 23/22 239/150
6,183,156 B1 * 2/2001 Morris ..... E04D 15/07 401/48

(Continued)

FOREIGN PATENT DOCUMENTS

WO 2011103094 A2 8/2011
WO 2012151513 A1 11/2012

*Primary Examiner* — Steven J Ganey
(74) *Attorney, Agent, or Firm* — Benesch, Friedlander, Coplan & Aronoff LLP

(57) ABSTRACT

A distribution apparatus for applying a one or two-part adhesive to a substrate includes a wand with a plurality of openings through which the adhesive is dispensed. An extension is connected in fluid communication to the wand. The extension directs a flow of adhesive to the wand.

21 Claims, 11 Drawing Sheets

(51) Int. Cl.

| | |
|---|---|
| ***B05B 7/04*** | (2006.01) |
| ***B05B 3/02*** | (2006.01) |
| ***B05B 7/24*** | (2006.01) |
| ***B05B 9/00*** | (2006.01) |
| ***B05C 17/00*** | (2006.01) |
| ***E04F 21/02*** | (2006.01) |
| ***B05C 5/02*** | (2006.01) |
| *A47G 27/04* | (2006.01) |

(52) U.S. Cl.

CPC ..... *B05B 7/04* (2013.01); *B05B 7/0466* (2013.01); *B05B 7/0475* (2013.01); *B05B 7/2472* (2013.01); *B05B 9/007* (2013.01); *B05C 5/027* (2013.01); *B05C 17/002* (2013.01); *B05C 17/005* (2013.01); *B05C 17/00553* (2013.01); *B05C 17/00583* (2013.01); *B05C 17/00589* (2013.01); *E04F 21/023* (2013.01); *A47G 27/0487* (2013.01)

(56) References Cited

U.S. PATENT DOCUMENTS

| | | | | |
|---|---|---|---|---|
| 6,817,798 | B2 * | 11/2004 | Kugler | E04D 15/07 401/48 |
| 7,056,556 | B2 | 6/2006 | Burns | |
| 2012/0074167 | A1 | 3/2012 | Galvin et al. | |
| 2014/0124567 | A1 | 5/2014 | Ulibarri et al. | |

* cited by examiner

| COMPARISON | A | B | C | D | E | F | G |
|---|---|---|---|---|---|---|---|
| PERFORMANCE | | | | | | | |
| GPM | 0.39 | 0.78 | | 1.09 (est) | | 1.37 (est) | 1.49 (est) |
| LPM (lbs/min) | 3.4 | 6.8 | | 9.6 (est) | | 12.0 (est) | 13.0 (est) |
| SPREADER WIDTH, inches | 12 | 19.7 | | 19.7 | | 19.7 | |
| COVERAGE, $ft^2$/min @ 85 $ft^2$/gal | 33 | 66 | | 93 | | 114 | 127 |
| COVERAGE, $ft^2$/min @ 100 $ft^2$/gal | 39 | 78 | | 109 | | 137 | 149 |
| | | | | | | | |
| TIME TO CONTAINER CHANGE-OUT, minutes | 25.6 | 12.8 | | 9.2 | | 7.3 | 6.7 |
| | | | | | | | |
| EQUIPMENT | | | | | | | |
| MOTOR (HP) | 0.25 | 0.5 | | 0.5 | | 0.5 | |
| | | | | | | | |
| PUMP | | | | | | | |
| | 2 ea. | 2 ea. | 2 ea. | 2 ea. | 2 ea. | 2 ea. | 2 ea. |
| MAX FLOW @ 1750 rmp, gpm, ea | 2.0 | 2.0 | 4.0 | 2.8 | 5.6 | 2.8 | 7.6 |
| FLOW @ rmp, both pumps gpm | 0.4 @ 175 | 0.8 @ 350 | | 1.12 @ 350 | 1.12 @ 175 | 1.40 @ 437.5 | 1.52 @ 175 |
| | | | | | | | |
| GEARBOX | | | | | | | |
| | | | | | | | |
| RATIO | 10:1 | 5:1 | 10:1 | 5:1 | 10:1 | 4:1 | 10:1 |
| | | | | | | | |
| | | | | | | | |

FIG. 7

ROOF ADHESIVE DISTRIBUTION APPARATUS

RELATED APPLICATIONS

This application is a National Stage filing under 35 U.S.C. §371 of PCT Application No. PCT/US2013/056429 filed 23 Aug. 2013 which claims the benefit of U.S. Provisional Patent Application Nos. 61/692,813, filed on Aug. 24, 2012; 61/713,292, filed on Oct. 12, 2012; 61/737,361, filed on Dec. 14, 2012; and 61/806,023, filed on Mar. 28, 2013. The contents of the above applications are incorporated herein by reference in their entirety.

FIELD

The present invention relates to a distribution apparatus and a method of using the distribution apparatus to dispense one-part and two-part adhesives for use with construction substrates, specifically roofing substrates, insulation boards, and roofing membranes.

BACKGROUND

In many construction applications, like roofing, flooring, pond liners, insulation, decking, and other flat layered structures, adhesives are employed to affix layers together. For example, in large, flat commercial roof decks, the roofing substrate is a concrete, light weight concrete, wood, gypsum, wood fiber or steel roof deck. In other construction applications like flooring, the substrates are tile floors, carpeting, vinyl floors or wood floors. In roofing, a common material is the water proofing membrane that is used to seal and protect the roof deck from environmental weather conditions and is placed over insulation boards, which provide insulative qualities. The insulation boards are typically secured to the roofing substrate or roof deck via an adhesive composition or fasteners. The roofing membrane may be made of various materials, such as polymeric materials including EPDM (ethylene propylene diene M-rubber), Mod Bit (Modified Bitumen), TPO (thermoplastic polyolefin), or polyvinyl chloride (PVC). The roofing membrane may also be a composite material that includes EPDM or TPO. The roofing membrane is adhered overtop insulation boards or panels using an adhesive composition such as mopping asphalt (typically Type III or Type IV) or other conventional adhesive compositions. Conventional adhesives normally are required to be applied to both the roofing membrane and the substrate.

Adhesives are typically dispensed in a bead form which lends to poor and inefficient distribution of the adhesive. This method typically results in excess use of adhesive which is costly and the uneven application leads to an undesirable finish on the roof Other application methods as spray yield a more even coating but require special personal protective equipment during the application.

A conventional adhesive composition used to adhere the roofing membrane to the roof deck or other substrate includes the use of an elastomer dissolved in solvent, such as, for example, a polychloroprene rubber in an acetone or toluene solvent. Other adhesives are based on waterborne emulsions of polychloroprene rubber However, while useful for their intended purpose, these water based adhesives may have issues regarding temperature restrictions, long curing times, odor concerns and freeze-thaw stability. In addition, these adhesives are contact adhesives that require full coverage between the substrate and the membrane. Accordingly, solvent and water based elastomer adhesives must be applied to both the substrate and the roofing membrane and cover substantially the entire surfaces of the adhering components. These adhesives can blister when used between two non-breathable surfaces due to the incomplete evaporation of solvent or water from the above adhesives. For example, blistering may occur on a new roof membrane when applied over an existing roof membrane in recover applications. These adhesives are typically applied by pouring them on the roof and squeegeeing them across the surface or using a mop.

Accordingly, there is room in the art for adhesive compositions and distribution apparatuses that dispense such compositions with improved quality in roofing applications.

SUMMARY

A distribution apparatus for applying a one or two-part adhesive to a substrate includes a wand with a plurality of openings through which the adhesive is dispensed. An extension is connected in fluid communication to the wand. The extension directs a flow of adhesive to the wand.

The present invention provides for a distribution apparatus that dispenses adhesive compositions for use in adhering insulation panels to roofing substrates and roofing membranes to the insulation panels or other substrates. The adhesive compositions are reactive polyurethane adhesives in one-part and two-part configurations. The adhesive composition may include a polyol, a prepolymer, and a curing agent.

The apparatus allows for even and efficient distribution of the adhesive in an environmentally and user friendly method. The apparatus further allows for even distribution without atomizing the adhesive, and the distribution is done at pressures that keep the adhesive from becoming air borne, which eliminates the need for costly personal protective equipment. It also makes more efficient use of the adhesive as it can be applied in a more even thin coating.

In a general aspect, an apparatus and method of applying adhesives is employed with construction substrates, including but not limited to flooring, decking, roofing substrates, insulation boards, and roofing membranes. The apparatus and method provide even and efficient distribution of the adhesive across a surface in a controlled manner so that a top substrate can be laid into the adhesive.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. The components in the figures are not necessarily to scale, emphasis instead being placed upon illustrating the principles of the invention. Moreover, in the figures, like reference numerals designate corresponding parts throughout the views. In the drawings:

FIG. 7 shows a table of comparisons for various distribution apparatuses and cart performance characteristics in accordance with the principles of the present invention;

DETAILED DESCRIPTION

Figure 1:
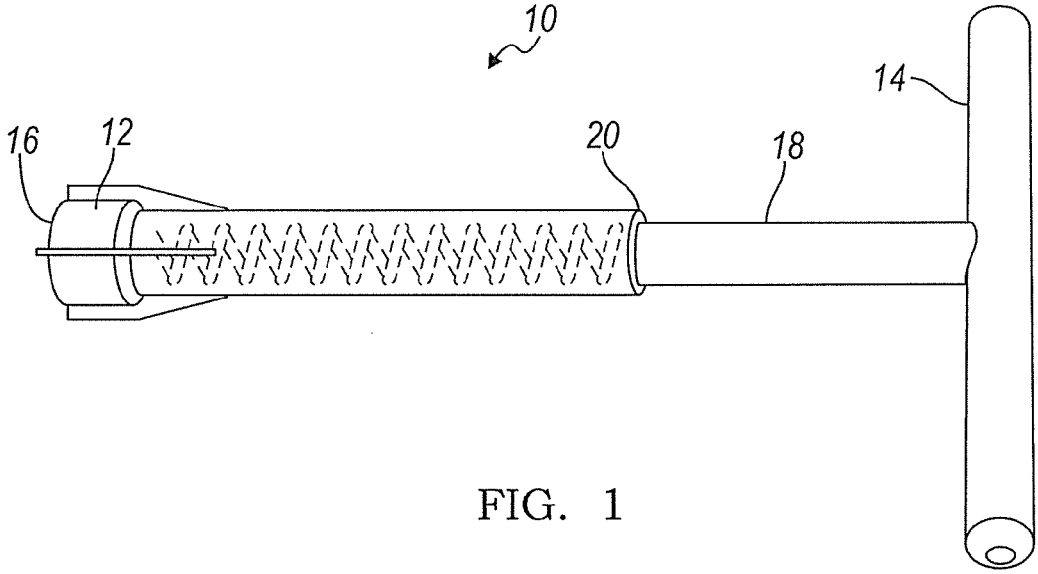
FIG. 1 shows a roofing adhesive distribution apparatus in accordance with the principles of the present invention.

The following description is merely exemplary in nature and is not intended to limit the present disclosure, application, or uses.

A roofing membrane is used to seal and protect the roof deck from environmental weather conditions and is placed over insulation boards that insulate the roof deck. The roof deck may take various forms including, for example, concrete, light weight concrete, wood, gypsum, wood fiber or steel roof deck. The insulation boards may be in various configurations such as sheets and be made of various materials without departing from the scope of the present invention. The roofing membrane may be made of various materials, such as, for example, polymeric materials including EPDM (ethylene propylene diene monomer-rubber), TPO (thermoplastic polyolefin), polyvinyl chloride (PVC), ketone ethylene ester (KEE), or SBS or APP Modified Bitumens. The roofing membrane may be a composite material that includes EPDM or TPO or other suitable membranes. An adhesive composition according to the principles of the present invention is provided for securing a first component, such as the above-described roofing membrane or insulation boards, to a second component or roofing substrate, such as a roof deck or existing roofing membrane. For example, in one embodiment, the adhesive composition adheres a new roofing membrane to an existing worn roofing membrane or surface. The existing roofing membrane may be cleaned with a pressure washer or broomed, swept or blown free of dirt and debris and the adhesive directly applied. Additionally, the cleaned roof can be primed with known commercial roofing primers prior to applying the adhesive. Alternatively, any combination of the above methods may be used.

The adhesive composition is either a one-part or a two-part reactive adhesive composition. The amount of the components included in the composition is selected to balance tack, cure speed and adhesion strength of the adhesive.

The adhesive composition is prepared by mixing the components prior to application on a substrate. In a one-part adhesive configuration, the components are mixed prior to packaging into a single container. The adhesive is then dispensed or otherwise applied to the roofing substrate or the roofing membrane and is cured in-situ via moisture cure.

In a two-part adhesive configuration, the adhesive is formed by combining two separate compositions or blends just prior to application on the roofing substrate. For example, the two parts may include a "B side" or resin side and an "A side" or prepolymer side. Each of the sides is packaged separately and is mixed by an applicator (as described below) prior to applying on the roofing substrate. The adhesive, once mixed, is dispensed or otherwise applied to the roofing substrate or the roofing membrane. During mixing, and after mixing, the components react to form a polyurethane adhesive having suitable physical properties. As noted above, the "A" Side and "B" Side components are preferably mixed by an applicator just prior to being dispensed or otherwise applied to the roofing substrate.

In addition, an applicator system in which individual components are brought together under ambient conditions and are mixed generally through a static mixer may be employed. The applicator system may include individual two-component cylinders or the two components may be brought together under various pumping methodologies and mixed through a static mixer.

Figure 2A:
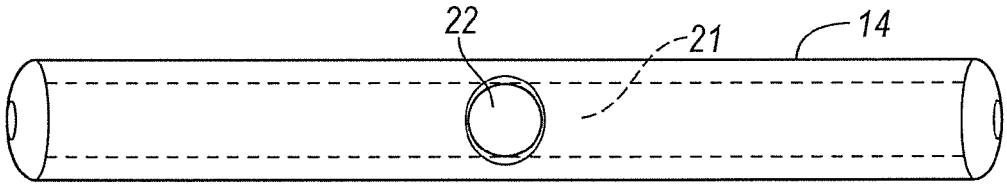
FIG. 2A shows an inlet portion of the roofing adhesive distribution apparatus.
Figure 2B:
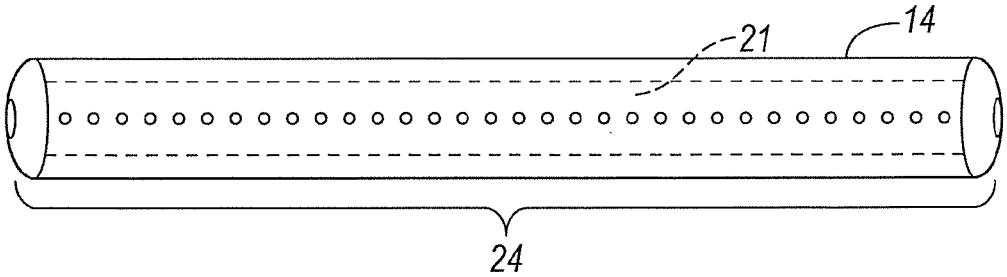
FIG. 2B shows exit openings of the roofing adhesive distribution apparatus.
Figure 3A:
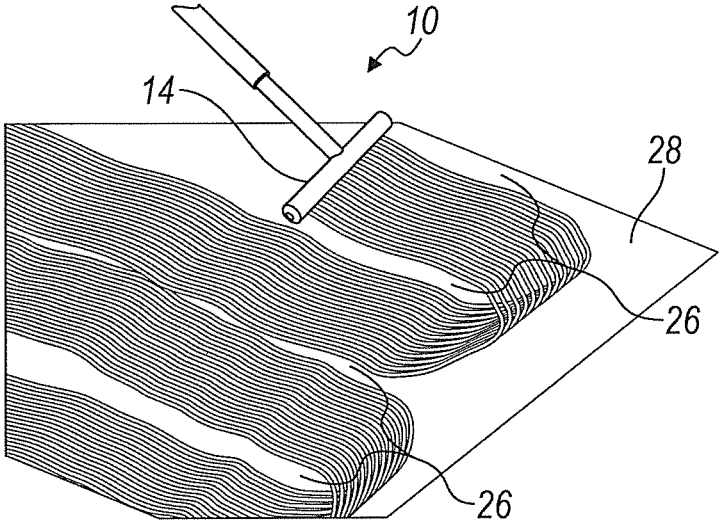
FIGS. 3A and 3B show adhesive being dispensed on a substrate with the roofing adhesive distribution apparatus of FIG. 1.
Figure 3B:
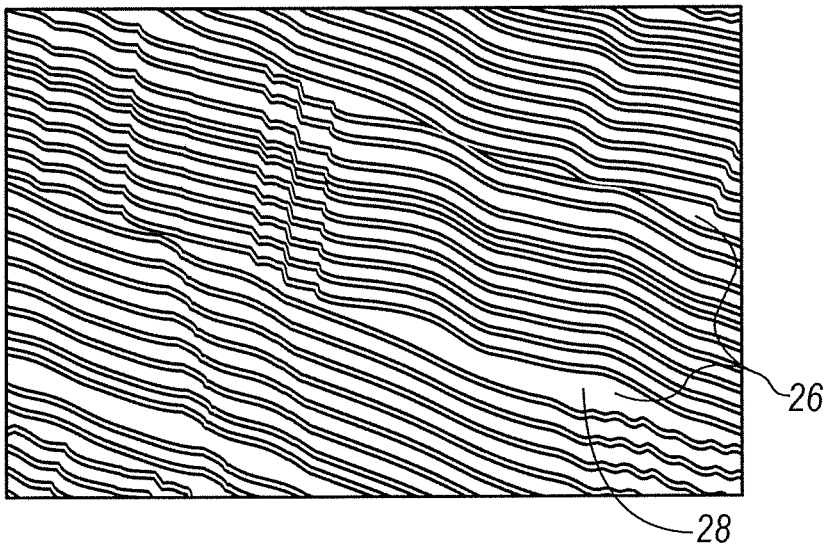

Referring now to FIGS. 1, 2A and 2B, there is shown a particular arrangement of adhesive distribution apparatus 10 for dispensing one-part or two-part adhesives. The apparatus and a method of applying adhesives with the apparatus are employed with construction substrates, including but not limited to flooring, decking, roofing substrates, insulation boards and roofing membranes.

The distribution apparatus 10 includes a static mixer 12 connected to a dispensing wand or spreader 14. One end 20 of the static mixer 12 can be coupled directly to the dispensing wand 14 at an opening 22 of the wand 14. Alternatively, the static mixer 12 is connected to an extension 18, which, in turn, is connected to the dispensing wand 14 at the opening 22. The other end 16 of the static mixer 12 receives the separated "A" and "B" components of the two-part adhesive or the apparatus can be employed without the static mixed such that the extension receives a one-part adhesive.

The end 16 may be connected to an outlet hose with separate channels for the "A" and "B" components. Or the end 16 may be connected to a manifold with two inlet ports for the "A" and "B" components that communicate with separate channels or bores which in turn communicate with respective outlet ports that forward the "A" and "B" components to the static mixer 12. Of course, the distribution apparatus 10 can be connected to single hose that supplies a one-part adhesive directly to the distribution apparatus 10 without the use of the static mixer The static mixer 12 is an extended member that mixes the "A" and "B" components. The static mixer can be disposable and has enough elements to properly mix the adhesive components. For a roofing urethane adhesive, this is preferably a 36 element mixer, though it should be appreciated that other types and grades of static mixers may be employed without departing from the scope of the present invention. Once the "A" and "B" components are mixed, the combined fluid exits the static mixer 12 and is dispensed into the extension 18 or directly to the dispensing wand 14. The static mixer 12 may be threaded into the manifold or hose mentioned above or it may be a quick release mixer for faster change-outs. That is, the mixer 12 may be configured to be quickly releasable from the manifold or hose by eliminating the threads and attaching the mixer 14 to the manifold or hose with a quick release mechanism or similar device.

The dispensing wand 14 includes an inner channel 21 that communicates with a set of openings or orifices 24. As such, as the mixed "A" and "B" fluid is pumped into the dispensing wand 14 from the static mixer 12 directly or via the extension 18, the mixed fluid flows through the channel 21 and exits the dispensing wand 14 through the openings 24.

The wand 14 can be made of PVC, PP or PE or any other suitable material. The length of the wand 14 may be between a couple of inches and a few feet. The wand 14 may have between one and a hundred openings, or more than a hundred openings depending on the application of the distribution apparatus 10.

Figure 4:
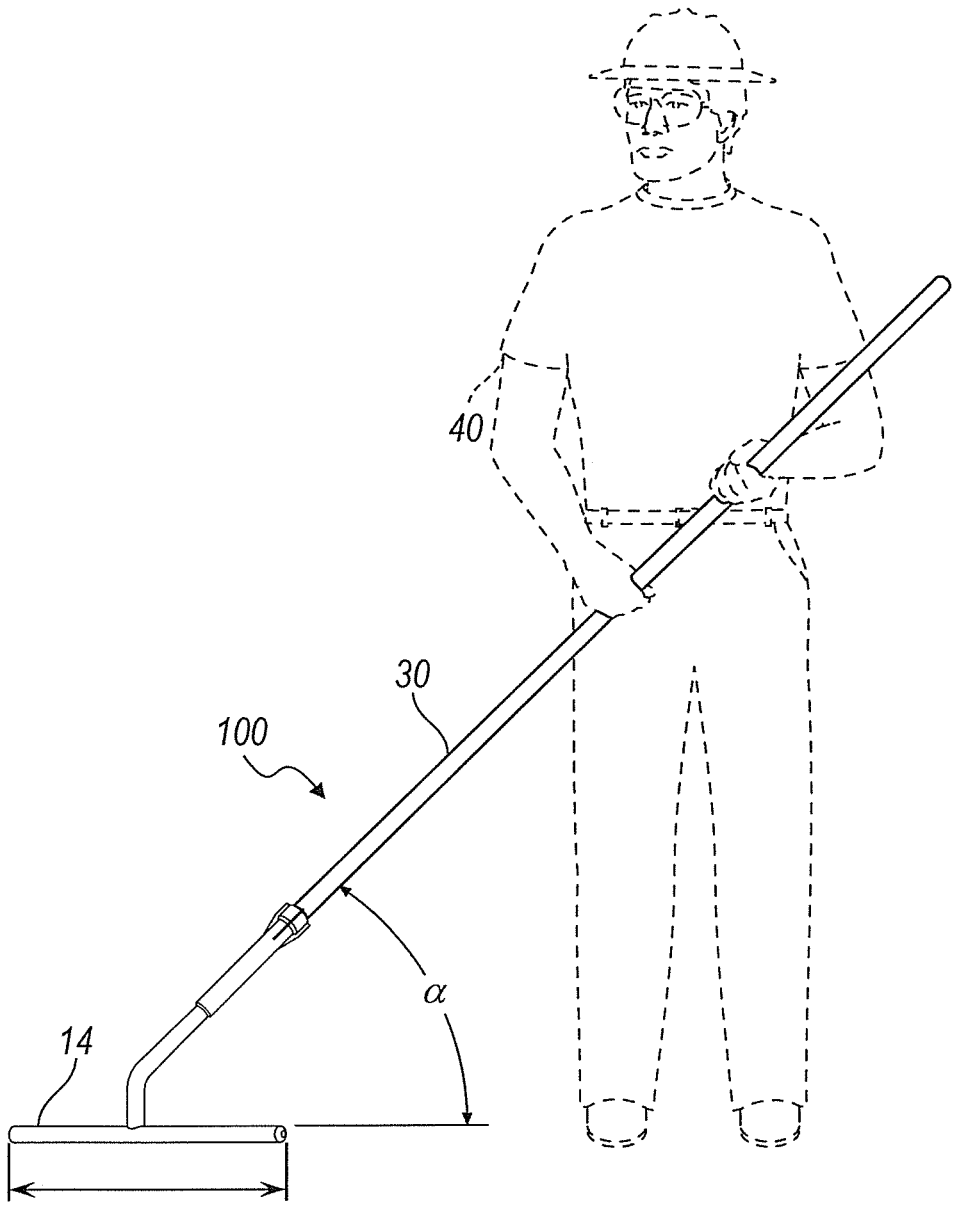
FIG. 4 shows alternative embodiment of a roofing adhesive distribution apparatus in accordance with the principles of the present invention.
Figure 5A:
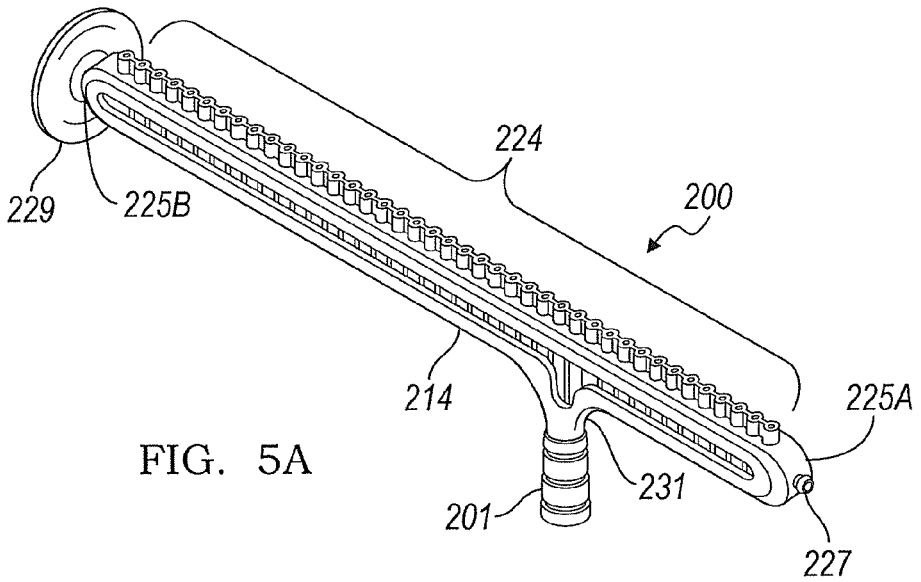
FIG. 5A is a perspective view of yet another embodiment of a roofing distribution apparatus in accordance with the principles of the present invention.
Figure 5B:
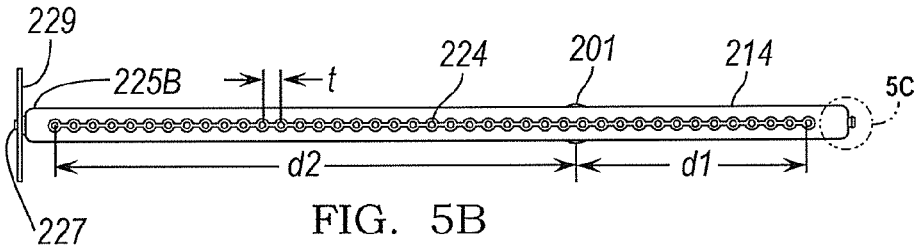
FIG. 5B is a bottom view of the roofing distribution apparatus of FIG. 5A.
Figure 5C:
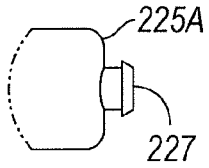
FIG. 5C is a close-up view of the region 5C in FIG. 5B.
Figure 5D:
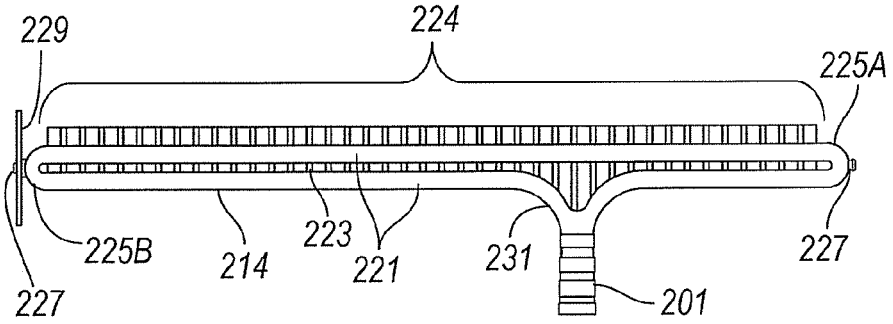
FIG. 5D is a side view of the roofing distribution apparatus of FIG. 5A.
Figure 5E:
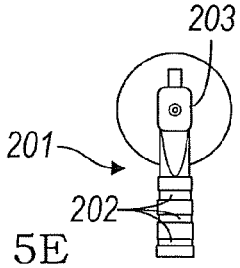
FIG. 5E is a close-up view of a snap-fit connector for connecting the roofing distribution apparatus of FIG. 5A to a static mixer.

Other arrangements are contemplated as well. For example, the dispensing wand 14 does not have to be a straight bar. It can be curved, round, square, diamond or any other suitable shape. The spacing between the openings 24 can be varied; that is, the spacing between the openings along the length of the dispensing wand 14 can be different. The size of the openings along the length of the dispensing wand 14 can be the same or different. The openings 24 can have different shapes, such as, for example, thin slots or non-circular shapes. The packaging for the adhesive components can be drums, cartridges, cylinders, bags or any other suitable packaging arrangement. Various types of pumping mechanisms can be employed, including battery operated, electrical or internal combustion engines. Hand guns, battery guns, and air guns can be employed to dispense the adhesive as well. Further pressurized air can be employed to pump the adhesive. Moreover, end fittings or wheels as discussed below can be added to the dispensing wand 14 to raise the center of the wand off the substrate and/or to make it easier to manipulate the wand 14. Further, wheels or posts or guides which could be a snap-on component or molded into the wand 14 allows the wand 14 to be in contact with the roof membrane for stability and ease as the adhesive is dispensed but keeps the wand openings 24 positioned above the roof membrane to allow adhesive to dispense freely. In a particular arrangement shown in FIG. 4, a distribution apparatus includes a wand 14 attached to a dispensing handle 30, with or without a static mixer, at an angle $\alpha$, so that the wand 14 can dispense adhesive while the wand 14 is positioned to the side of a user 40.

Further arrangements include, but are not limited to, a wand with one continuous slot rather than a series of holes, slots or openings of various shapes. The dispensing wand 14 can be rotatable relative to the static mixer 12, the extension 18, or the handle connected to the static mixer to align the wand with the dispensing direction. The swivel or pivoting wand can provide for right and left handed applications and corner changes.

The distribution apparatus 10 can include a detached tray or a tray attached to the wand 14 to catch adhesive that may drain out the wand 14 after typical use to avoid creating a mess on the roof surface. The distal ends of the wand 14 can have openings to provide even pressure distribution of the adhesive in the wand 14. The diameter of the channel 21 may vary to achieve uniform flow of adhesive across the length of the wand 14. For example, the inside diameter channel 21 can be narrower in the middle and flare to a larger diameter as the channel 21 extends to the ends of the wand 14.

The wand 14 can be Y-shaped or V-shaped to effectively make two spreaders spaced apart. The wand 14 can be telescoping to allow it to be expandable or collapsible to accommodate variable widths, depending on the application (such as spreading adhesive in roof corners versus spreading adhesive in on open area of membrane).

Rather than a single channel 21 providing flow of adhesive to the openings 24, the wand 14 can be formed with multiple channels, so that each channel provides flow adhesive to an individual opening to direct adhesive to the ends of the wand 14 and provide consistent flow of adhesive at all openings. This prevents static areas in the wand 14 where adhesive is not dispensing so that is nothing gets hung up in the corners of the wand 14.

In a particular arrangement, the wand 14 is about 12 inches long and is made from PVC. The openings 24 in the wand 14 are spaced apart by about ¼ inch, so that there are about 50 openings. At each end of the wand 14, there are eighteen ⅛ inch holes, and at the center region there are fourteen 3⁄32 inch holes. Accordingly, in this configuration, there are from end to end of the wand 14 eighteen ⅛ inch holes followed by fourteen 3⁄32 inch holes followed by 18⅛ inch holes.

In sum, various shapes, sizes and designs of the wand 14 and shapes and patterns of the dispensing openings in the wand 14 are contemplated, including continuous openings, spaced elongated openings, regular and irregular openings and opening spacing that form both continuous and discontinuous sheets of adhesive. Various arrangements of the method of use dispensing apparatus include, but are not limited to, various packaging reservoirs, dispensing equipment, mixers for use with 2K adhesives, patterns of application, amount of adhesive and various adhesive chemistries. The dispensing apparatus 10 can be employed with various construction substrates, for example, various roofing materials and membranes. The wand 14 can be manufactured from various materials based on use and service life. The distribution apparatus can include components that aid the use of the apparatus, such as ergonomic and application aids, including handles, support straps, wheels, support, swivels and etc. Various devices and methods may be employed to prolong the use of the distribution apparatus 10. For example, the distribution apparatus 10 and the use of the apparatus can be employed to move cured or soon to be cured adhesive out of the wand 14. In addition to dispensing adhesive, the distribution apparatus may also be able to employed to smooth the membrane onto the over the underlying substrate.

Turning now to FIGS. 5A-5E, with further reference to FIGS. 1, 2A and 2B, there is shown a particular arrangement for a distribution apparatus 200 for dispensing one-part or two-part adhesives. The distribution apparatus 200 is coupled to a static mixer 12, as described above, with a quick-release snap connection 201. Specifically, the snap connection 201 is provided with a set of grooves 202 that facilitate connecting to one end 20 of the static mixer 12. The wand 214 is part of the distribution apparatus 200 (one piece) and snaps onto the static mixer directly via the snap connection 201. Recall, the other end 16 of the static mixer 12 receives the separated "A" and "B" components of the two-part adhesive or receives a one-part adhesive, or the extension 18 receives the one-part adhesive without the use of the static mixer 12 so that extension is connected to the wand 214 with the snap connection 201. The snap connection 201 is leak proof and allows rotary adjustment of the wand 214 on the static mixer 12 so that the operator can customize the angle of the wand 214 during application of the adhesive.

The end 16 may be connected to an outlet hose with separate channels for the "A" and "B" components, or the end 16 may be connected to a manifold with two inlet ports, as described previously.

Again, the static mixer 12 is an extended member that mixes the "A" and "B" components, such that after the "A" and "B" components are mixed, the combined fluid exits the static mixer and is dispensed into the dispensing wand 214.

The dispensing wand 214 includes a perimeter channel 221 that communicates with a set of nozzles 224. As such, as the mixed "A" and "B" fluid is pumped into the dispensing wand 214 from the static mixer 12, the mixed fluid flows through the channels 221 and exits the dispensing wand 214 through the nozzles 224. Note that the flow of adhesive from the static mixer is divided and distributed through the channels 221 to the two ends 225*a* and 225*b* of the wand 214 to provide uniform distribution of adhesive to the nozzles 224. The dispensing wand 214 also includes a set of cross-channel holes 223, so that as the channels 221 are filled with adhesive, some adhesive passes through the cross-channel holes that are aligned with the nozzles 224 to reduce dead zones in front of the nozzles 224.

The wand 214 includes a pair of studs 227 located at the two ends 225*a* and 225*b*. The studs 227 provide a mechanism to affix a wheel 229 at each end. The distribution apparatus 200 can be employed with or without the snap-on wheels 229. When the wheels 229 are employed, the wheels 229 support the weight of the distribution apparatus 200, the static mixer 12, and a hose assembly (described below) for improved ergonomics. The wheels 229 position the nozzles 224 a fixed, uniform distance from the rooftop and keeps the wand 214 horizontal for a more uniform application of the adhesive.

In the arrangement shown in FIGS. 5A-5D, the wand 214 includes a neck 231 that is offset. That is, the neck 231 is at a distance d1 from the end 225*a* and a distance d2 from the end 225*b*, with d1 not equal to d2. The offset neck provides alternatives for the operator to position his or her body for improved ergonomics. Flipping the wand 214 over offers a second configuration for improved accessibility in confined areas on a rooftop. In some arrangements, d1 is about 6.1 inches and d2 is about 13.3 inches.

In general, the nozzles 224 are spaced uniformly on centers. In one particular arrangement, there are sixty four nozzles 224 spaced on 5/16 inch centers. This spacing is sufficiently close so that the adhesive beads from the nozzles 224 merge after the top cover is applied and rolled. The individual beads are not visible through the top cover and blistering is prevented. (Blistering occurs from trapping many small pockets of air when the top cover is applied.) Note that the nozzles 224 extend from the wand 214. The extended length of the nozzles 224 provides sufficient back pressure to distribute the flow evenly among all the nozzles 224. Note also that the diameter of each nozzle is sized to produce bead velocity that promotes uniform width of the beads and uninterrupted distribution of the beads.

The wand 214 can be made of PVC, PP or PE or any other suitable material. The length of the wand 214 may be between a couple of inches and a few feet. In alternative arrangements, the wand 214 may have between one and a hundred openings, or more than a hundred openings depending on the application of the distribution apparatus 10.

Figure 6:
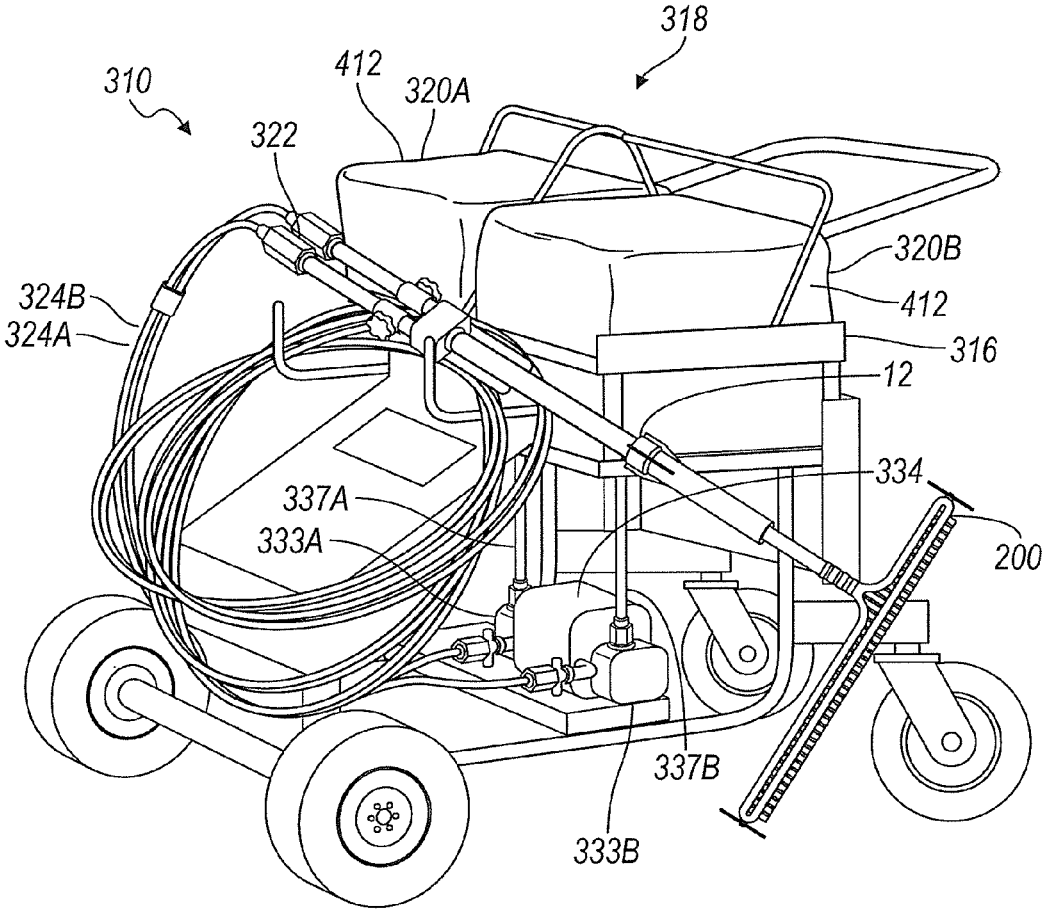
FIG. 6 is a perspective view of a cart assembly for providing adhesive to a roofing distribution apparatus in accordance with the principles of the present invention.

FIG. 6 shows an adhesive cart 310 for applying a two-part fluid to a substrate. The adhesive cart 310 is a CYCLONE adhesive applicator available from ADCO Products, Inc. of Chagrin Falls, Ohio. The cart 310 includes a carrier or frame 312 that supports the various components of the cart 310. The carrier 312 includes a rectangular base with two rotatable front wheels and two spindle mounted back wheels. The back wheels are pivotable and rotatable allowing the cart 310 to move forward as well as turn and rotate. The cart 310 includes an upper frame 316 that accommodates two parts of a two-part compound 318. These two parts are packaged separately and include an "A" side package 320A and a "B" side package 320B. Each of the packages contain one part of a two part all weather polyurethane adhesive for use on roofing substrates. As shown, each package 320A and 320B includes its respective part contained in a flexible bag 412 (described below).

Figure 8A:
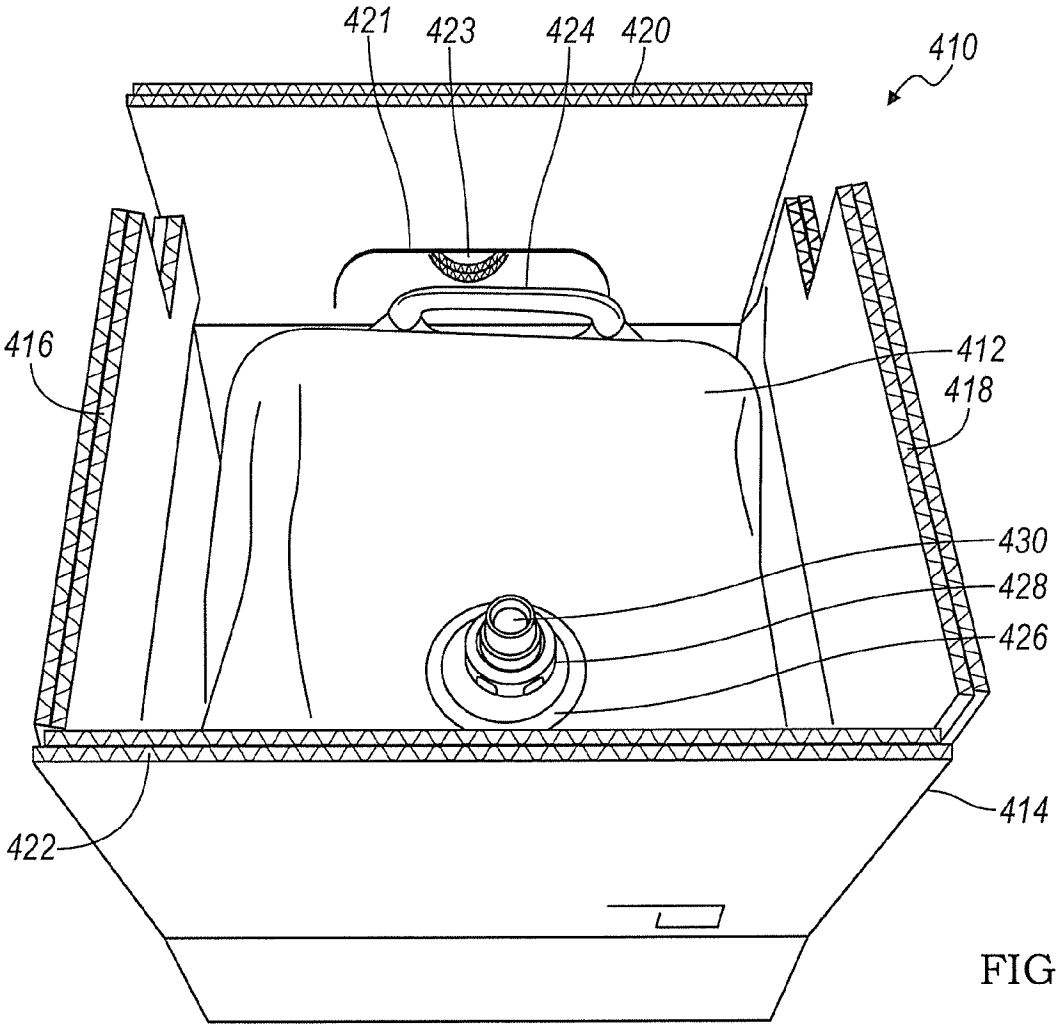
FIGS. 8A through 8D show an alternative embodiment of an adhesive package for the cart assembly of FIG. 6 in accordance with the principles of the present invention.
Figure 8B:
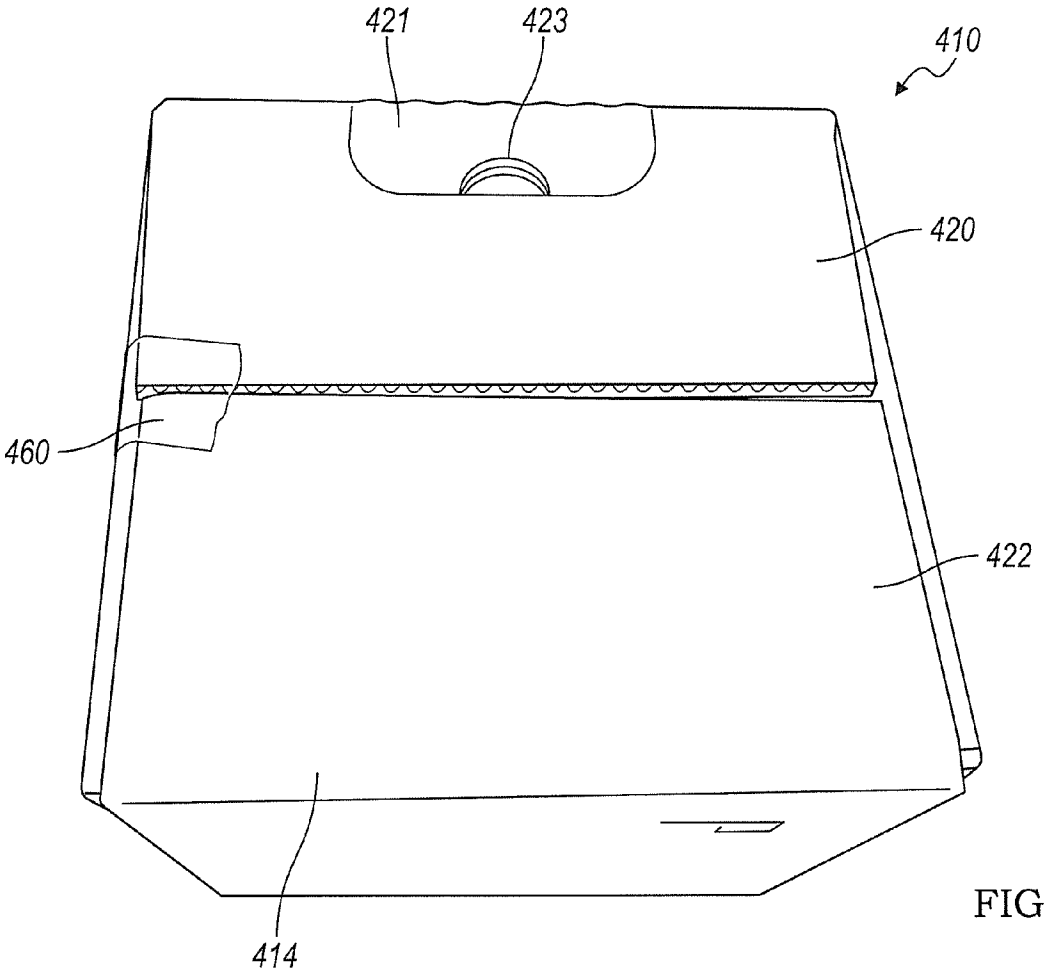
Figure 8C:
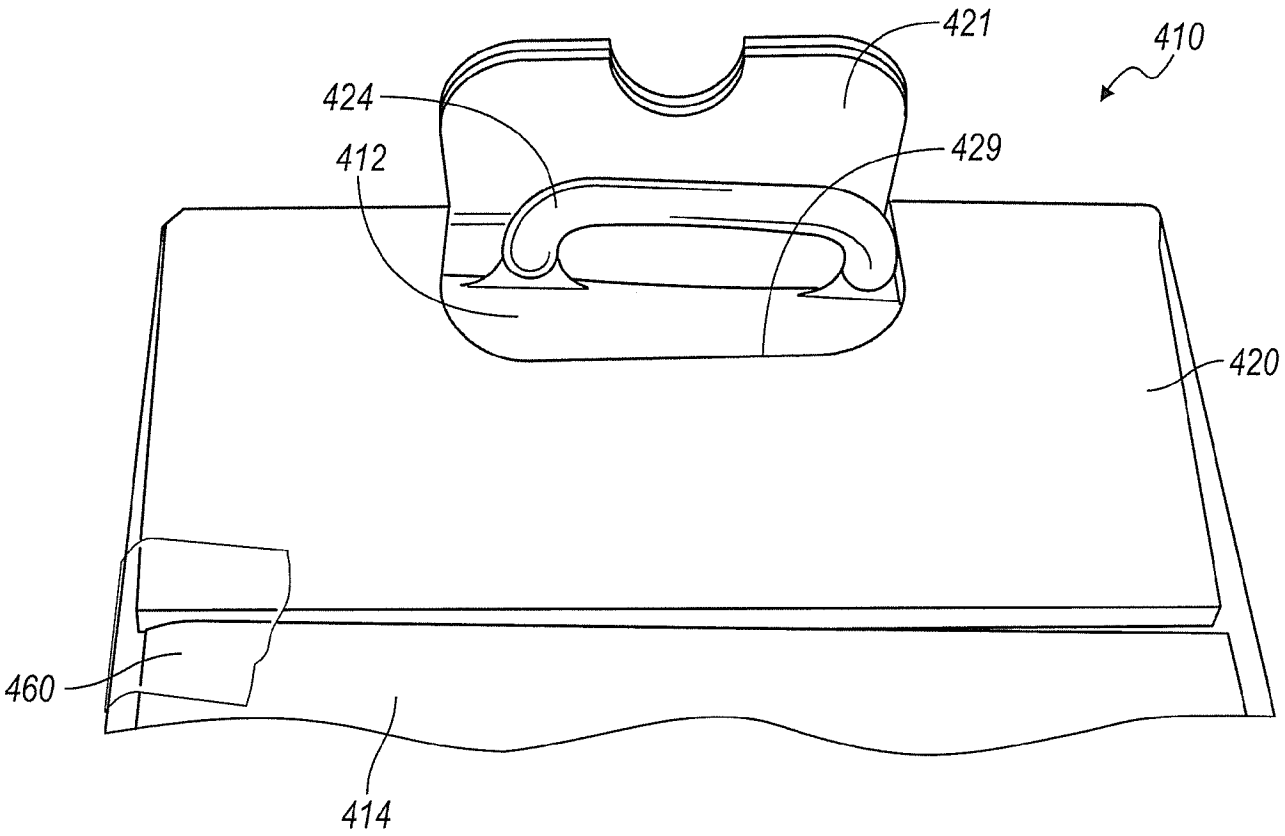

The cart 310 includes a pair of electrically operated pumps 333A and 333B. Each pump 333A, 333B includes an inlet that is connected with a fluid passage 337A, 337B to a dispensing nozzle (for example, a valved device 428 shown in FIG. 8A) of a respective package 320A and 320B. In certain arrangements, each pump 333A, 333B may include an outlet connected via hose or other type of fluid passage to inlet ports of a manifold attached to the front of the upper frame 316. In such arrangements, each inlet port communicates with a bore that extends through the manifold that, in turn, communicates with a respective outlet port on the manifold. Each of the outlet ports of the manifold is connected to an applicator unit 322 through a pair of hoses 324A and 324B.

Alternatively, each pump 333A, 333B is connected directly to a respective hose 324A, 324B. Accordingly, the pumps pull "A" side and "B" side components by suction from the packages 320A and 320B and pumps the components through the manifold or directly through the hoses 324A and 324B to the applicator unit 322, which receives the "A" side component through the hose 324A and the "B" side component through the hose 324B.

The cart 310 may also include a gear box 334 that is connected to a prime mover such as, for example, an electric motor or combustion engine. The gear box 334 transfers torque from the electric motor directly to the pumps 333A, 333B or via rotatable shafts.

The applicator 322 includes an extended nozzle portion 326, such as the static mixer 12 described above, that mixes the "A" side fluid with the "B" side fluid. The nozzle portion 326 or the static mixer is connected to any one of the distribution apparatuses described earlier.

Note that the cart 310 can be sized to receive four packages for the two parts of the two-part compound 318. In such an arrangement, the two parts are packaged separately and include two "A" side packages and two "B" side package. Again, each package contains one part of a two part all weather polyurethane adhesive for use on roofing substrates.

In some arrangements, the "A" side and "B" side packages for the cart 310 can include a flexible member enclosed in a carton like container, both of which are loaded onto the adhesive pump cart. For example, each may be stored in a collapsible bag disposed within a box such as Cubitainer® by Hedwin or Cheertainer® by CDF, stored in rigid containers such as drums or barrels, paired in cylinders, or in flexible, fully compressible structures such as collapsible tubes that dispense the materials. Alternatively, the flexible member can be removed from the container and then loaded onto a pump cart, as shown and as described below.

Referring now to FIG. 7, there is shown a table of comparison of various implementations A through G of the distribution apparatus in accordance with the principles of the present invention. Specifically, the table in FIG. 7 shows coverage performance characteristics using different wand lengths and various pump flow rates. In general, high pump flow rates are associated with wider wands 14, 214. Note that the table merely illustrates certain implementations of the distribution apparatus and is not meant to limit its scope, since other implementations of the distribution apparatus are contemplated as well. In some implementations, the motor employed in these examples can be obtained from Baldor Motor Inc. The pumps employed in these examples can be obtained from Viking Pump Inc.

Also note that the components shown in FIG. 7 are not limited for use with the wands 14 or 214. These components, in various combinations, can be employed in an adhesive distribution apparatus that uses a single nozzle to disperse the adhesive onto a substrate, or these components can be employed with a multi-bead applicator such as the apparatuses described in commonly owned U.S. Pat. No. 7,056,556 issued Jun. 6, 2006 and in PCT Patent Application No. PCT/US11/24898, filed Feb. 15, 2011, which are hereby incorporated by reference in their entirety. Other applicators that can employ these components include, for example, battery powered applicators, spray wand applicators, spray rig applicators, pressurized canister applicators, low-pressure pump applicators, and other compatible adhesive applicator devices. Note, as indicated in FIG. 7, the gear box 334 shown in FIGS. 5A-5D can be a two-speed gear box that drives the pumps 333A, 333B at two different flow rates or a multi-speed gear box that drives the pumps 333A, 333B at more than two different flow rates.

Referring now to FIGS. 8A-8D the drawings, a bulk packaging unit 410 for storing and transporting an adhesive or a component of an adhesive for use with the cart 310 is shown. The packaging unit 410 includes an inner flexible member or bag 412 contained in an outer container or carton 414. The bag 412 is made of a water-impermeable flexible material and has a spout 426. The bag 412 is filled with an adhesive or a component or part of an adhesive. In some arrangements, a screw cap is removed from the spout and then the adhesive or adhesive component is poured into the bag 412 until the adhesive or adhesive component fills the bag 412. When the bag 412 is being filled, the bag 412 can reside in the carton 414 or can be outside the carton 414 and then placed into the carton after the bag is filled. In either case, the bag 412 closely conforms to the interior of the carton 414 when the bag 412 is filled with the adhesive or adhesive component.

The bag 412 receives the adhesive or adhesive component for pre-use storage, shipping, use in an adhesive applicator, and post-use storage. The bag 412 is generally made of a suitable plastic material that can be translucent or transparent to facilitate viewing of the contents in the bag 412. The spout 426 generally includes threads to allow threading of the spout with the threads of the cap. After the bag is filled with the adhesive or adhesive component, the screw cap can be twisted on the spout 426 or a valved device 428 can be connected or attached, for example, by threading threads of the valved device 428 to the spout 426 to seal the contents of the bag 412. Accordingly, the bag 412 and its contents can be shipped in the carton 414 with a screw cap or the valved device 428. The valved device 428 can include a poppet valve 430 that engages a stem member of a conduit to facilitate flow of the contents of the bag 412 from the bag. The valved device can be a quick release or connect nozzle for faster change outs and connection with a conduit. Such quick connect couplers or nozzles include those available from Colder Products of St. Paul, Minn. The bag 412 can further include a handle 424 that allows the bag 12 to be carried and to be placed and removed from the carton 414. In a particular arrangement, the handle 424 extends through an opening 429 in the carton 414 after the carton 414 is closed off to enclose the bag 412 in the carton 414 to enable the bag 412 with its contents and the carton 414 to be carried together.

The carton 414 is in some arrangements is a corrugated rigid or semi-rigid, box-like structure made from a die cut panel. The carton 414 encloses the bag 412 and, hence, supports and protects the bag 412 and its contents for transportation and use of the packaging unit 410. The carton 414 includes two inner panels 416 and 418 and two outer panels 420 and 422. After the bag 412 is placed in the carton 414, the two inner panels 416 and 418 are folded in and then the outer panels 420 and 422 are folded in on top of the inner panels 416 and 418. Again, the bag 412 can be filled with its contents prior to being placed in the carton 414 or after it is placed in the carton 414. The panels 420 and 422 can be sealed shut with a piece of tape 460 on one or both sides of the seam formed by the adjacent edges of the panels 420 and 422 or the panels 420 and 422 can be sealed by any other suitable means.

The panel 420 is provided with a flap portion 421 than can be pulled out to define the opening 429. In some arrangements the panel 420 includes a small opening 423 that allows the placement of a finger or thumb to pull out the flap portion 421 so that the handle 424 of the bag 412 can extend through the opening 429 as described previously.

Figure 8D:
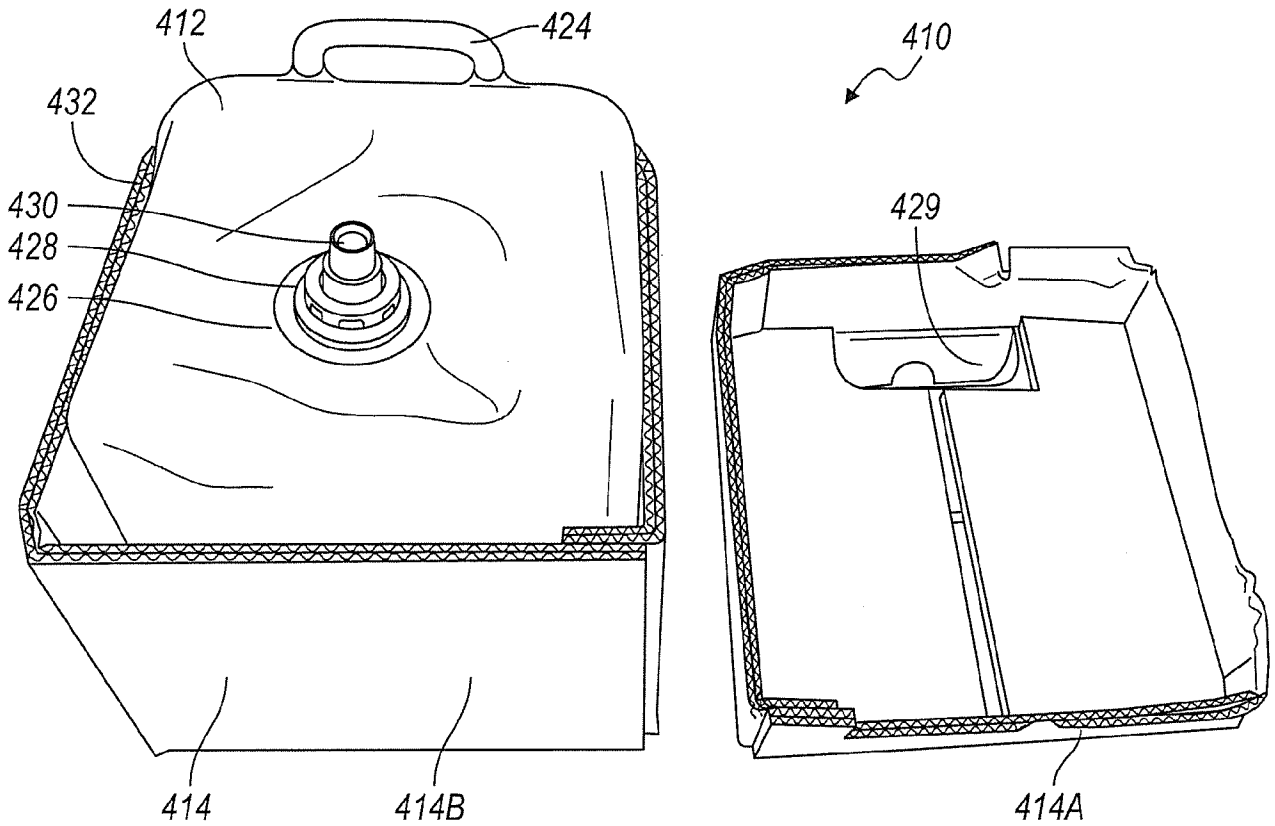

In particular arrangements, the carton includes a tear tape 434 that is pulled to separate the carton 414 along a perforation 432. Specifically, as shown in FIG. 8D, the perforation allows the carton 414 to be separated into a top portion 414A and a bottom portion 414B. The perforation 432 is located about a distance, 1, from the top of the carton 414. Accordingly, when the packaging unit 410 is in use, an operator can remove the top portion 414A to allow access to the bag 412 with its contents so that the bag 412 can be removed from the bottom portion 414B and connected to an adhesive applicator (for example, the cart 310) with the valved device 428, such as the quick connect device described above. Further details and arrangements are described in U.S. patent application Ser. No. 13/669,954, filed Nov. 6, 2012, the entire contents of which are incorporated herein by reference.

Figure 9:
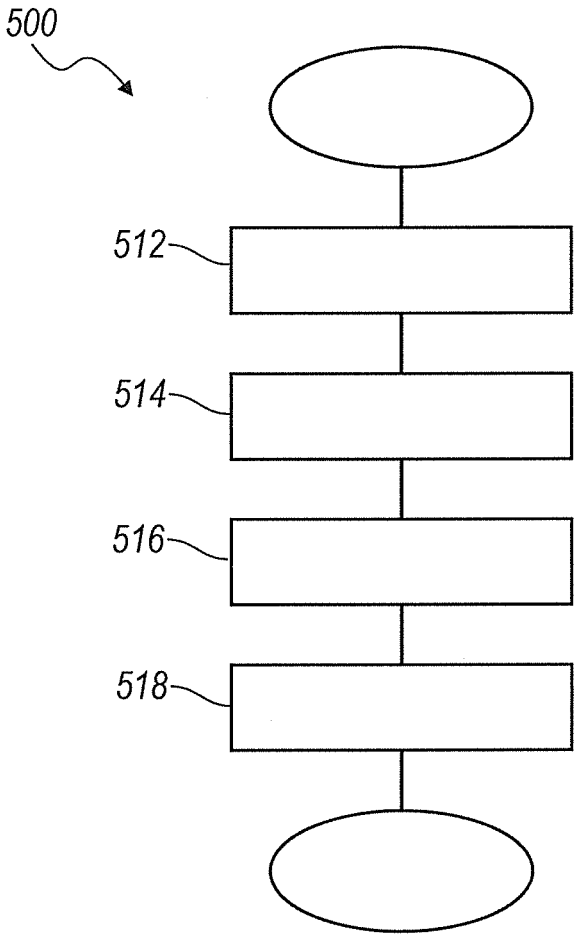
FIG. 9 is a flow diagram of a method of distributing adhesive in accordance with the principles of the present invention.

Referring to FIG. 9, there is shown a method of adhering a "neat" EPDM roofing membrane to a roof member with the cart 310 and anyone of the distribution apparatuses 10, 100, or 200 in flowchart format and indicated by the reference number 500. A "neat" EPDM roofing membrane is described in the present specification to mean a non-fleeced, non-primed, non-surface treated EPDM membrane. In alternative embodiments, other neat water impervious roofing membranes are incorporated. In a step 512, at least one adhesive container is provided to the cart 310. In the example provided, the adhesive is the two-part adhesive described in the examples above. The "A" and "B" side components or pre-mixed one-part adhesive may be packaged in several ways and in several types of containers. The adhesive may be stored in a collapsible bag disposed within a box (known as Bag in the Box) as described earlier, stored in Twin Pack Cartridges, stored in rigid containers such as drums or barrels, paired in cylinders, or in flexible, fully compressible structures such as collapsible tubes or collapsible bags that dispense the materials. For example, the adhesive may be stored in a CUBITAINER package available from the Hedwin Corporation of Baltimore, Md. Alternatively, the adhesive may be stored in an adhesive cartridge as described in commonly owned U.S. Provisional Patent Application No. 61/539,271, filed Sep. 26, 2011 or a collapsible bag container such as described in commonly owned U.S. patent application Ser. No. 13/246,498, filed Sep. 28, 2011, both of which are incorporated here by reference in their entirety. In another arrangement, the bags holding the two components are delivered in their respective boxes. The bags are then removed from the boxes and coupled to the applicator system as discussed previously. Such adhesive packaging is described in detail in U.S. application Ser. No. 13/669,954, filed Nov. 6, 2012, the entire contents of which is incorporated herein by reference.

In a step 514, the at least one adhesive container is connected to the adhesive cart 310. In alternative arrangements, the adhesive applicator device is the adhesive applicator described in commonly owned U.S. Pat. No. 7,056,556 issued Jun. 6, 2006, which is hereby incorporated by reference as to the technical disclosure of the adhesive applicator. In yet other arrangements, other adhesive applicator devices may be used, such as multi-bead applicators, battery powered applicators, spray wand applicators, spray rig applicators, pressurized canister applicators, low-pressure pump applicators, and other compatible adhesive applicator devices. For example, in one embodiment, the adhesive applicator device is a POWERPUSH applicator available from Meritool LLC of Ellicottville, N.Y. In another alternative embodiment, the adhesive applicator device is a CR-20 delivery system available from 3M of St. Paul, Minn. In yet another alternative embodiment, the adhesive applicator is a PREDATOR PUMP adhesive applicator available from Graco Inc. of Minneapolis, Minn.

In a step 516 the adhesive is applied to at least one of the EPDM membrane and the roof member with the adhesive apparatus 10, 100, or 200. In the example provided, the roof member is an aged, existing EPDM membrane on a previously assembled roof. The aged, existing EPDM membrane is preferably pressure washed, but not treated or primed. In alternative embodiments, the roof member is a treated or primed EPDM membrane, a smooth surface modified bitumen including SBS and AAP modified bitumens, a smooth surface built-up roof, a concrete roof deck, a wood roof deck, a gypsum roof deck, a polyisocyanurate, XPS, EPS, fiberglass, rockwool, or other insulation member, an isocyanate, gypsum, or other rigid cover board, a steel roof decking, or a TECTUM roof deck member available from Tectum Inc. of Newark, Ohio. It should be appreciated that other roof members may be incorporated without departing from the scope of the present invention.

Furthermore, the adhesive may be applied using various procedures. In the example provided, the "A" side and "B" side of a two-part adhesive is first mixed in the static mixer 12 and then dispensed with the wand 14 or 214. During and after mixing, the components react to form a polyurethane adhesive having suitable physical properties. Due to the reactive nature of the adhesive composition, the adhesive composition may be applied in ribbon or bead method and may be applied to only one side of the substrate or roofing membrane. It should be appreciated that no mixing is performed when a one-part adhesive is used.

The neat EPDM member is then applied in full coverage or "broomed" in by applying pressure to the neat EPDM using the wand 14 or 214 as a broom to press the EPDM into the adhesive and reduce wrinkles in the installed neat EPDM. In various alternative embodiments, the adhesive is ribbon applied to the neat EPDM, applied in full coverage to the roof member, applied in full coverage to the neat EPDM, ribbon applied to one of the neat EPDM and the roof member and then spread into full coverage, or applied to both the neat EPDM and the roof member in any combination of ribbon application and full coverage application. Additionally, the neat EPDM may be rolled onto the roof member, broomed onto the roof member, "flopped" onto the roof member, or brought into contact with the roof member in various other ways without departing from the scope of the present invention.

It should be appreciated that various types of adhesive applicator devices may be used with various adhesive application methods. For example, forms of application include using a cartridge, using low pressure pumping of the two components and mixing them with a static mixer, or using high pressure tanks that are brought to about 500-1500 psi with an inert dry gas, such as Nitrogen. In the latter form of application, the "A" and "B" side materials are metered as two individual components and brought together and mixed by high pressure impingement or by a static mixer 12 and then applied in a bead or ribbon form.

Next, the roofing membrane is rolled or otherwise positioned overtop of the adhesive composition and the roofing substrate. The adhesive composition then cures and secures the roofing membrane to the roofing substrate. Due to the formulation of the adhesive composition of the present invention, the roofing substrate and the roofing membrane may be untreated, that is, no primer or membrane fleece back is required to achieve the desired adhesive strength. The multi-bead applicator may also be used to apply the adhesive composition in a one-part configuration.

In a step 518 heat is applied to the newly installed neat EPDM membrane. In the example provided, a heated roller is applied over the neat EPDM to promote the exothermic reaction in cold weather installations. It should be appreciated that other methods of applying heat may be incorporated or the application of heat may be omitted without departing from the scope of the present invention.

The method of adhering a "neat" EPDM roofing membrane to a roof member provides several advantages over existing methods. The present method provides a VOC free application using curable chemistry between two water-impervious membranes. Furthermore, the present method does not require a fleece backing or priming to adhere the EPDM roofing membrane to the roof member.

In various arrangements the two-part adhesive exhibits a slow reaction initiation time to allow greater wet out of the substrates for improved adhesion. Some imidazole structures (permethylated nitrogen) act as latent catalysts and are more effective after heat aging of the polymer. Other imidazole structures (active hydrogen) produce blocked isocyanates that become un-blocked with heat.) Various two-part adhesives exhibit an acceptable cure time of the adhesive which allows for enough green strength to resist wind up-lift forces on a roof (This improvement is from polymer viscosity build and tensile strength increase.) The two-part adhesive can exhibit an acceptable cure time of the adhesive to lock down the membranes to allow normal activities on a roof (This improvement is from polymer viscosity build and tensile strength increase.) The two-part adhesive in some implementations has an NCO to OH ratio resulting in a soft polymer with a modulus of less than 500 psi and is tacky with a T-peel breakaway strength of greater than 0.5 pli.

The two-part adhesive can contain an MDI isocyanate pre-polymer having a high 2-4' content which exhibits a slow reaction initiation time to allow greater wet out of the substrates for improved adhesion. (This is due to a balance of 4-4' MDI with 2-4' MDI allowing for fast polymer formation from 4-4' and slower reaction and good wet-out due to steric hindrance of the 2-4'.) Certain two-part adhesives contain Di-ethanol amine or other additives which disrupt the hard/soft segment blocks of the polyurethane adhesive resulting in a soft polymer with good peel strength (see for example #9 below). The two-part adhesives can contain an acid composition that can alter the surface tension or chemistry of the adhesive or membrane allowing for better wet out or creation of reactive sites and improved adhesion.

In some arrangements, air or an inert gas can be injected at low pressure at the top of the static mixer 12 through a fitting where the static mixer is attached to the "A" and "B" lines supplied by the individual pumps. Note that If the valves that feed the static mixer 12 and distribution apparatus 10, 100, or 200 are shut off for any reason the "A" and "B" components may react and form a solid polymer. When shut down occurs, however, if air or the inert gas is injected into the static mixer and distribution apparatus while the mixture of the "A" and "B" components is still a liquid, the air or inert gas will displace the liquid "A" and "B" mixture allowing further use of the static mixer/distribution apparatus.

Further note that the above adhesive compositions are not limited to being applied in full coverage. For example, these adhesive compositions can be applied with an apparatus in beads or ribbons, such as described in International Application PCT/US12/36570 filed May 4, 2012, U.S. Provisional Patent Application No. 61/721,866 filed Nov. 2, 2012, and U.S. Provisional Patent Application No. 61/806,022, filed on Mar. 28, 2013, all the contents of which are all incorporated herein by reference.

The invention can be more readily understood by reference to the following examples which are intended to illustrate, but not limit the scope of, various embodiments of the adhesive composition of the present invention:

Example 1

One-Part Adhesive

| Material | Exemplary Trade Name | Percent by Weight |
|---|---|---|
| Polyol | STEPANPOL 2352 | 25-35% |
| Moisture cure prepolymer | RUBINATE 9272 | 60-70% |
| Catalyst | 2,2-dimorphorlinodiethylether | 1.0-5.0% |

Example 2

Two-Part Adhesive

| Material | Exemplary Trade Name | Percent by Weight of total | Percent by Weight of side |
|---|---|---|---|
| "B" or Resin Side | | | |
| Polyol | JEFFOL PPG-2000 | 45-55% | 92-98% |
| Curing Agent | IMICURE AMI-1 | 2.0-3.0% | 0.5-5.0% |
| "A" or Prepolymer Side | | | |
| Prepolymer | RUBINATE 1209 | 45-55% | 92-98% |
| Catalyst | 2,2-dimorphorlinodi-ethylether | 1.0-5.0% | 0.5-5.0% |

Example 3

Two-Part Adhesive

| Material | Exemplary Trade Name | Percent by Weight of total | Percent by Weight of side |
|---|---|---|---|
| "B" or Resin Side | | | |
| Polyol | JEFFOL PPG-2000 | 30-40% | 92-98% |
| Curing Agent | IMICURE AMI-1 | 2.0-3.0% | 0.5-5.0% |
| "A" or Prepolymer Side | | | |
| Prepolymer | RUBINATE 9272 | 60-70% | 92-98% |
| Catalyst | JEFFCAT DMDEE | 1.0-5.0% | 0.5-5.0% |

Example 4

Two-Part Adhesive

| Material | Exemplary Trade Name | Percent by Weight | |
|---|---|---|---|
| "B" or Resin Side | | | |
| Polyol | JEFFOL PPG-1000 | 45-55% | 92-98% |
| Curing Agent | IMICURE AMI-1 | 2.0-3.0% | 0.5-5.0% |
| "A" or Prepolymer Side | | | |
| Prepolymer | RUBINATE 1209 | 45-55% | 92-98% |
| Catalyst | JEFFCAT DMDEE | 1.0-5.0% | 0.5-5.0% |

Example 5

Two-Part Adhesive

| Material | Exemplary Trade Name | Percent by Weight | |
|---|---|---|---|
| "B" or Resin Side | | | |
| Polyol | JEFFOL PPG-1000 | 45-55% | 92-98% |
| Catalyst | IMICURE AMI-1 | 1.0-3.0% | 0.5-5.0% |
| "A" or Prepolymer Side | | | |
| Prepolymer | RUBINATE 9272 | 45-55% | 92-98% |
| Catalyst | JEFFCAT DMDEE | 1.0-5.0% | 0.5-5.0% |

Examples 6, 7, 8 and 9

Two-Part Adhesives

| Components | Trade Name | 6 Wt % | 7 Wt % | 8 Wt % | 9 Wt % |
|---|---|---|---|---|---|
| "B" or Resin Side | | | | | |
| Polyol | JEFFOL PPG-2801 | 95.20 | 94.45 | 94.45 | 93.65 |
| Catalyst | IMICURE AMI-1 | 4.80 | 4.80 | 4.80 | 4.80 |
| | DABCO TMR-3 | | 0.50 | 0.50 | 0.50 |
| | Di-ethanolamine | | | | 0.80 |
| Blowing Agent | Water | | 0.25 | 0.25 | 0.25 |
| "A" or Prepolymer Side | | | | | |
| Prepolymer | RUBINATE 9404 | 100.0 | | | 100.00 |
| | RUBINATE 9040 | | 100.0 | | |
| | RUBINATE 9009 | | | 70.0 | |
| Additive | PAROIL 140LV | | | 30.0 | |

Examples 10, 11, and 12

Two-Part Adhesives

| Components | Trade Name | 10 Wt % | 11 Wt % | 12 Wt % |
|---|---|---|---|---|
| "B" or Resin Side | | | | |
| Polyol | JEFFOL PPG-2801 | 96.75 | 96.75 | 96.75 |
| Catalyst | POLYCAT 8 | 3.00 | | |
| | DABCO 33LV | | 3.00 | |
| | POLYCAT 5 | | | 3.00 |
| Blowing Agent | Water | 0.25 | 0.25 | 0.25 |
| "A" or Prepolymer Side | | | | |
| Prepolymer | RUBINATE 9272 | 70.00 | 70.00 | 70.00 |
| Additive | PAROIL 10 | 30.00 | | 15.00 |
| | PAROIL 8707 | | 30.00 | 15.00 |

Examples 13, 14, and 15

Two-Part Adhesives

| Components | Trade Name | 13 Wt % | 14 Wt % | 15 Wt % |
|---|---|---|---|---|
| "B" or Resin Side | | | | |
| Polyol | JEFFOL PPG-2801 | 96.75 | 96.75 | 96.75 |
| Catalyst | POLYCAT 5 | 3.00 | 3.00 | 3.00 |
| Blowing Agent | Water | 0.25 | 0.25 | 0.25 |
| "A" or Prepolymer Side | | | | |
| Prepolymer | RUBINATE 9272 | 70.00 | 70.00 | 70.00 |
| Additive | PAROIL 140 | 30.00 | | |
| | PAROIL 142LV | | 30.00 | |
| | PAROIL 45 | | | 30.00 |

Examples 16, 17, and 18

Two-Part Adhesives

| Components | Trade Name | 16 Wt % | 17 Wt % | 18 Wt % |
|---|---|---|---|---|
| "B" or Resin Side | | | | |
| Polyol | JEFFOL PPG-2801 | 96.75 | 96.75 | 96.75 |
| Catalyst | POLYCAT 5 | 3.00 | 3.00 | 3.00 |
| Blowing Agent | Water | 0.25 | 0.25 | 0.25 |
| "A" or Prepolymer Side | | | | |
| Prepolymer | RUBINATE 9272 | 70.00 | 70.00 | 70.00 |
| Additive | PAROIL 1045 | 30.00 | | |
| | PAROIL 42 | | 30.00 | |
| | PAROIL 54NR | | | 30.00 |

Examples 19, 20, and 21

Two-Part Adhesives

| Components | Trade Name | 19 Wt % | 20 Wt % | 21 Wt % |
|---|---|---|---|---|
| "B" or Resin Side | | | | |
| Polyol | JEFFOL PPG-2801 | 96.75 | 96.75 | 96.75 |
| Catalyst | POLYCAT 5 | 3.00 | 3.00 | 3.00 |
| Blowing Agent | Water | 0.25 | 0.25 | 0.25 |
| "A" or Prepolymer Side | | | | |
| Prepolymer | RUBINATE 9272 | 70.00 | 70.00 | 70.00 |
| Additive | PAROIL 140 LV | 30.00 | | |
| | PAROIL 50 | | 30.00 | |
| | PAROIL 145 | | | 30.00 |

Examples 22, 23, and 24

Two-Part Adhesives

| Components | Trade Name | 22 Wt % | 23 Wt % | 24 Wt % |
|---|---|---|---|---|
| "B" or Resin Side | | | | |
| Polyol | JEFFOL PPG-2801 | 96.75 | 96.75 | 96.75 |
| Catalyst | POLYCAT 5 | 3.00 | 3.00 | 3.00 |
| Blowing Agent | Water | 0.25 | 0.25 | 0.25 |
| "A" or Prepolymer Side | | | | |
| Prepolymer | RUBINATE 9272 | 70.00 | 70.00 | 70.00 |
| Additive | PAROIL 53NR | 30.00 | | |
| | PAROIL 40 | | 30.00 | |
| | PAROIL 10 | | | 30.00 |

Each of examples 2-23 are mixed in a 1:1 ratio. Alternative weight percentages and mixing ratios may be incorporated without departing from the scope of the present invention. Additionally, it should be appreciated that the exemplary trade name materials referenced are for illustration purposes only, and that suitable equivalent manufacturers may be employed. In addition, composition may include other additives without departing from the scope of the present invention.

The following table includes test data for Examples 6-23 after the adhesive formulations are applied between two 45 mil RUBBERGARD EPDM membrane strips available from Firestone. The breakaway strength is determined on an Instron machine using a "T" peel testing setup as defined by ASTM D1876.

| Sample | Breakaway Strength - aged 24 h @ 75 F. (in pli) | Breakaway Strength - aged 24 h @ 158 F. (in pli) | Breakaway Strength - aged 24 h @ 212 F. (in pli) |
|---|---|---|---|
| Example 6 | 2.32 | 3.26 | 5.03 |
| Example 7 | 1.32 | 1.94 | 3.81 |
| Example 8 | 0.9 | 1.22 | 1.3 |
| Example 9 | 1.33 | — | 2.61 |
| Example 10 | 0.87 | 1.19 | 1.24 |
| Example 11 | 1.57 | 1.42 | 1.76 |
| Example 12 | 1.87 | 1.49 | 1.75 |
| Example 13 | 1.14 | — | 1.79 |
| Example 14 | 0.67 | — | 1.11 |
| Example 15 | 0.96 | — | 1.29 |
| Example 16 | 1.36 | — | 1.65 |
| Example 17 | 1.74 | — | 2.16 |
| Example 18 | 1.17 | — | 1.98 |

-continued

| Sample | Breakaway Strength - aged 24 h @ 75 F. (in pli) | Breakaway Strength - aged 24 h @ 158 F. (in pli) | Breakaway Strength - aged 24 h @ 212 F. (in pli) |
|---|---|---|---|
| Example 19 | 1.23 | — | 1.05 |
| Example 20 | 1.3 | — | 2.05 |
| Example 21 | 1.11 | — | 1.16 |
| Example 22 | 1.67 | — | 1.58 |
| Example 23 | 0.8 | — | 0.95 |
| Example 24 | 1.11 | — | 1.54 |

Examples 25, 26, 27 and 28

Two-Part Adhesives

| Components | Trade Name | 25 Wt % | 26 Wt % | 27 Wt % | 28 Wt % | 29 Wt % | 30 Wt % |
|---|---|---|---|---|---|---|---|
| "B" or Resin Side | | | | | | | |
| Polyol | JEFFOL PPG-2801 | 94.45 | 94.45 | 94.45 | 94.45 | 92.45 | 91.95 |
| Catalyst | IMICURE AMI-1 | 4.80 | 4.80 | 4.80 | 4.80 | 4.80 | 4.80 |
| Catalyst | Dabco TMR-3 | 0.50 | 0.50 | 0.50 | 0.50 | 0.50 | 0.50 |
| Blowing Agent | Water | 0.25 | 0.25 | 0.25 | 0.25 | 0.25 | 0.25 |
| Chain Extender | Glycerin | | | | | 2.0 | 2.5 |
| "A" or Prepolymer Side | | | | | | | |
| Prepolymer | Lupranate 5020 | 100.00 | 90.00 | | | | |
| Additive | Rubinate 9272 | | | 90.00 | 90.00 | | |
| | Cereclor S-52 | | 10.00 | | 10.00 | | |
| | Rubinate 9040 | | | | | 100.00 | 100.00 |

| Sample | Breakaway Strength - aged 7 days @ 75 F. (in pli) | Breakaway Strength - aged 7 days @ 158 F. (in pli) | Breakaway Strength - aged 7 days @ 212 F. (in pli) |
|---|---|---|---|
| Example 25 | 1.29 | — | 7.62 |
| Example 26 | 1.96 | — | 14.13 |
| Example 27 | 0.83 | — | 3.29 |
| Example 28 | 0.97 | — | 9.88 |
| Example 29 | 1.12 | | |
| Example 30 | 1.12 | | |

Examples 31, 32, 33, 34 and 35

Two-Part Adhesives PSA's

| Components | Trade Name | 31 Wt % | 32 Wt % | 33 Wt % | 34 Wt % | 35 Wt % |
|---|---|---|---|---|---|---|
| "B" or Resin Side | | | | | | |
| Polyol | JEFFOL PPG-1000 | 100.00 | 89.73 | 85.00 | 80.28 | 75.56 |
| Polyol | Lupranol SG-360 | | 4.72 | 9.45 | 14.17 | 18.89 |
| Catalyst | IMICURE AMI-1 | 4.80 | 4.80 | 4.80 | 4.80 | 4.80 |
| Catalyst | Dabco TMR-3 | 0.50 | 0.50 | 0.50 | 0.50 | 0.50 |
| Blowing Agent | Water | 0.25 | 0.25 | 0.25 | 0.25 | 0.25 |
| "A" or Prepolymer Side | | | | | | |
| Prepolymer | Rubinate 9040 | 100.00 | 100.00 | 100.00 | 100.00 | 100.00 |

| Sample | Breakaway Strength - aged 7 days @ 75 F. (in pli) | Breakaway Strength - aged 7 days @ 158 F. (in pli) | Breakaway Strength - aged 7 days @ 212 F. (in pli) |
|---|---|---|---|
| Example 31 | 0.40 | 2.07 | 1.81 |
| Example 32 | 2.10 | 3.15 | 3.67 |
| Example 33 | 1.40 | 1.73 | 1.90 |

-continued

| | | | |
|---|---|---|---|
| Example 34 | 1.10 | 1.27 | 1.60 |
| Example 35 | 0.70 | 0.71 | 0.93 |

Example 6 exhibited a 135 psf wind uplift rating and Example 7 exhibited a 120 psf wind uplift rating when tested using the Factory Mutual 4470 test method. Specifically, the adhesive formulations were applied as part of an installed single-ply roofing system on a wind uplift resistance table. Within the system, the adhesives adhered 45 mil Firestone RUBBERGARD EPDM membrane onto 0.5 inch Firestone ISO Gard HD Coverboard, which was adhered to Firestone 1½" ISO 95+ GL Polyisocyanurate Insulation Board with Firestone I.S.O. Twin Pack Insulation Adhesive.

Alternatively, the examples given above may also be tested under negative pressure uplift conditions according to a Factory Mutual 1-52 test method.

The examples given above each have a low modulus of elasticity. For example, the provided example 7 has a modulus of 121.5 psi. Similarly, the remaining examples also have soft and flexible characteristics that promote mobility of the chlorinated paraffins within the adhesive.

In various arrangements, the adhesive compositions described above may or may not include paraffins or other adhesion promoters. Any of the compositions may include chain extenders such as, for example, glycerin, di-ethylene glycol etc. for back end cure speed improvements. The addition of glycerin or similar chemistries provides a formulation that performs as a roofing adhesive over a wide application temperature range. This allows sufficient wet-out time during the initiation of the reaction time to allow for adhesive to the roofing substrate. Further, the formulation with glycerin or similar chemistries exhibits acceptable completion of reaction to make the membrane resistant to wind up-lift forces in a timely manner. In certain compositions with glycerin or similar chemistries, the application temperature range for these compositions have a range from about 0° F. to about 190° F.

The adhesive compositions may be PSA adhesives. Such adhesives can be readily dispensed as a liquid that cures to its final form within a desired period of time with final physical properties (i.e. pressure sensitive adhesive) that allow it to adhere to, for example, a polymeric sheet with adequate bond strength to resist application stresses.

The compositions can include high molecular weight polymer additions such as tackifiers and rheology modifiers. The reduction or elimination of entrapped air can be obtained through polymer cure speed, polymer rheology or the method of applying the adhesive. For example, employing faster polymer viscosity increase or use of the spreader to trap less air between membranes.

Further details of the chemistry composition are described in commonly owned U.S. Provisional Patent Application No. 61/806,022, filed on Mar. 28, 2013 and entitled "REACTIVE ROOFING ADHESIVE," the entire contents of which are incorporated herein by reference.

The description of the invention is merely exemplary in nature and variations that do not depart from the gist of the invention are intended to be within the scope of the invention. Such variations are not to be regarded as a departure from the spirit and scope of the invention.

What is claimed is:

1. A distribution apparatus for applying a one or two-part adhesive to a substrate, the distribution apparatus comprising:

a wand with a plurality of openings through which the adhesive is dispensed, the wand further comprising at least one perimeter channel and a set of cross channel holes, wherein each cross channel hole is aligned with at least one of the plurality of openings; and an extension connected in fluid communication to the wand, wherein the extension directs a flow of adhesive to the wand.

2. The distribution apparatus of claim 1 wherein each of the plurality of openings is circular.

3. The distribution apparatus of claim 1 wherein one or more of the plurality of openings is non-circular.

4. The distribution apparatus of claim 1 wherein the plurality of openings are equally spaced.

5. The distribution apparatus of claim 1 wherein the spacing between the openings of the plurality of openings is varied.

6. The distribution apparatus of claim 1 wherein the wand is a straight bar.

7. The distribution apparatus of claim 1 wherein the extension is a static mixer that mixes a first part and a second part of a two-part adhesive.

8. The distribution apparatus of claim 1 wherein the extension is connected to a static mixer that receives a first part and a second part of a two-part adhesive, mixes the first part and the second part of the two-part adhesive, and directs the two-part adhesive to the extension.

9. The distribution apparatus of claim 1 wherein the wand has a first end and a second end, a distance from the first end to where the extension is connected to the wand being less than a distance from the second end to where the extension is connected.

10. The distribution apparatus of claim 1 further comprising a first wheel attached to a first end of the wand and a second wheel attached to a second end of the wand.

11. The distribution apparatus of claim 10 wherein the wheels space the wand a uniform distance from the substrate.

12. The distribution apparatus of claim 1 further comprising a quick-release snap connection that connects the extension to the wand.

13. A distribution apparatus for applying a two-part adhesive to a substrate, the distribution apparatus comprising:

a cart with a frame that supports a first collapsible bag that contains a first part of the two part adhesive, a second collapsible bag that contains a second part of the two part adhesive, a first pump in fluid communication with the first collapsible bag, and a second pump in fluid communication with the second collapsible bag;

an extension in fluid communication with the first pump and the second pump, the first pump and the second pump drawing the first part and the second part of the two-part adhesive, respectively, and directing the first part and the second part of the two-part adhesive to the extension, the extension mixing the first part and the second part of the two-part adhesive to form the two-part adhesive; and a wand with a plurality of openings, the wand receiving the two-part adhesive and dispensing the two-part adhesive through the plurality of openings onto the substrate.

14. The distribution apparatus of claim 13 wherein each of the plurality openings is circular.

15. The distribution apparatus of claim 14 wherein the plurality of openings are equally spaced.

16. The distribution apparatus of claim 13 wherein the extension is a static mixer that mixes a first part and a second part of a two-part adhesive.

17. The distribution apparatus of claim 13 wherein the wand has a first end and a second end, a distance from the first end to where the extension is connected to the wand being less than a distance from the second end to where the extension is connected.

18. The distribution apparatus of claim 13 further comprising a first wheel attached to a first end of the wand and a second wheel attached to a second end of the wand.

19. The distribution apparatus of claim 18 wherein the wheels space the wand a uniform distance from the substrate.

20. The distribution apparatus of claim 13 wherein the cart includes a gear box that drives the first pump and the second pump.

21. The distribution apparatus of claim 20 wherein the gear box has two or more speeds to drive the pumps at two or more flow rates.

* * * * *